US009316037B1

(12) United States Patent
Couvertier, II

(10) Patent No.: US 9,316,037 B1
(45) Date of Patent: Apr. 19, 2016

(54) CHICAGO/BARREL BOLT DOOR STOP

(71) Applicant: Douglas Couvertier, II, Weston, FL (US)

(72) Inventor: Douglas Couvertier, II, Weston, FL (US)

( * ) Notice: Subject to any disclaimer, the term of this patent is extended or adjusted under 35 U.S.C. 154(b) by 0 days.

(21) Appl. No.: 14/625,859

(22) Filed: Feb. 19, 2015

Related U.S. Application Data

(60) Provisional application No. 61/995,129, filed on Apr. 4, 2014.

(51) Int. Cl.
*E05F 5/06* (2006.01)
*E05F 5/02* (2006.01)

(52) U.S. Cl.
CPC .... *E05F 5/06* (2013.01); *E05F 5/02* (2013.01)

(58) Field of Classification Search
CPC ..... E05F 5/02; E05F 5/06
USPC ..... 16/82, 85, 86 R, 86 A
See application file for complete search history.

(56) References Cited

U.S. PATENT DOCUMENTS

| | | | | | |
|---|---|---|---|---|---|
| 383,809 | A * | 5/1888 | Herrick | E05F 5/06 | 16/86 A |
| 918,060 | A * | 4/1909 | Kabureck | E05F 5/06 | 16/86 A |
| 2,596,780 | A * | 5/1952 | Meyers | B60G 7/04 | 16/86 A |
| 2,819,921 | A * | 1/1958 | Solari | E05C 17/52 | 16/86 A |
| 2,882,547 | A * | 4/1959 | Bacon | E05F 5/06 | 16/85 |
| 4,699,552 | A * | 10/1987 | Jeal | B21K 1/70 | 411/282 |
| 2012/0131879 | A1* | 5/2012 | Bergman | E04F 11/1812 | 52/704 |

* cited by examiner

*Primary Examiner* — Emily Morgan
(74) *Attorney, Agent, or Firm* — Albert Bordas, P.A.

(57) ABSTRACT

A Chicago barrel bolt doorstop assembly having a doorstop with a first shaft extending between a distal end and a butt end. Protruding from the butt end is a post assembly having a post. The post assembly further has internal threads. A fastener has a second shaft with threads, a head, and a third end. The threads extend from the third end towards the head. To mount onto a door, the first end of the post assembly is presented into a hole from a first side of the door, and the third end of the fastener is presented into the hole from a second side of the door, whereby the hole extends between the first and second sides of the door. The first end receives the third end and the fastener tightens into the post assembly.

1 Claim, 2 Drawing Sheets

CHICAGO/BARREL BOLT DOOR STOP

BACKGROUND OF THE INVENTION

1. Field of the Invention

The present invention relates to doorstops, and more particularly, to improved doorstops to prevent a doorknob from causing damage when opening a door to an adjacent wall.

2. Other Related Applications

The present non-provisional patent application is filed under 35 U.S.C. 119(e) and claims the benefit of Provisional Application No. 61/995,129, filed on Apr. 4, 2014, which is hereby incorporated by reference.

3. Description of the Related Art

Prior art doorstops are typically mounted onto a bottom corner of a door. Baseboards are a decorative finish attached to walls along a perimeter of a room where the walls and floor meet. The doorstop makes contact with the baseboard prior to the doorknob making contact with the wall, consequently preventing the doorknob from impacting the wall and causing damage. However, prior art doorstops often compromise the bottom corner of the door, typically damaging it, and ultimately fall off the door completely.

Prior art doorstops provide for a number of more or less complicated features that fail to solve the problem in an efficient and economical way. None of those prior art doorstops suggest the novel features of the present invention.

SUMMARY OF THE INVENTION

The present invention is a Chicago barrel bolt doorstop assembly. More specifically, the present invention is a Chicago barrel bolt doorstop assembly, comprising a doorstop having a first shaft extending between a distal end and a butt end. Protruding from the butt end is a post assembly comprising a post extending between first and second ends. The post assembly further comprises internal threads. A fastener comprises a second shaft having threads, a head, and a third end. The threads extend from the third end towards the head. The Chicago barrel bolt doorstop assembly may further comprise a bumper assembly, whereby the bumper assembly comprises a bumper head and a cap snugly fits onto the bumper head.

To mount the present invention, the first end of the post assembly is presented into a hole from a first side of a door, and the third end of the fastener is presented into the hole from a second side of the door. The hole extends between the first and second sides of the door. The first end receives the third end and the fastener tightens into the post assembly. The door comprises at least one doorknob.

It is therefore one of the main objects of the present invention to provide a Chicago barrel bolt doorstop assembly that mounts securely onto door assemblies.

It is another object of this invention to provide a Chicago barrel bolt doorstop assembly without compromising the door assembly.

It is another object of this invention to provide a Chicago barrel bolt doorstop assembly, which is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
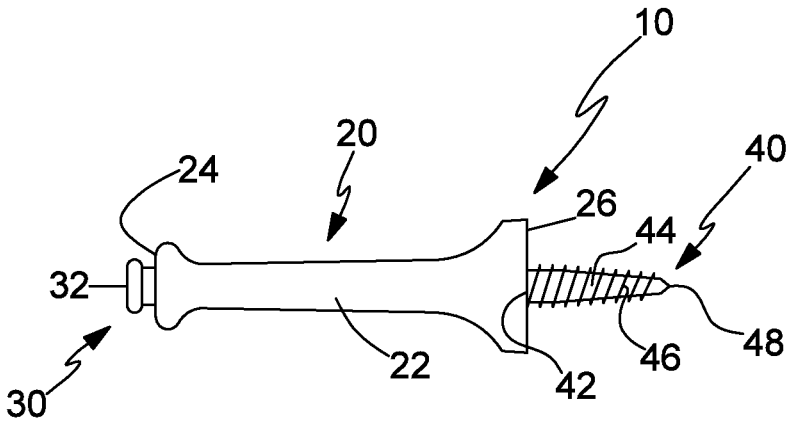
Prior Art FIG. 1
FIG. 1 represents a side view of a prior art doorstop assembly.

Referring now to the drawings, the present invention is a Chicago barrel bolt doorstop assembly and is generally referred to with numeral 100. It can be observed that it basically includes doorstop 120, post assembly 140, and fastener 150.

Doorstops extend a first distance from a door side/surface whereto they are mounted. Doorknobs extend a second distance from the same door side/surface whereto they are mounted. A doorstop is generally mounted to the door side/surface, and when open, makes contact with the wall. Walls generally have baseboards, which are a decorative finish attached to the walls along a lower perimeter of the room walls. The first distance is greater than the second distance, so the doorstop contacts the baseboards, thus preventing the doorknob from damaging the wall.

Seen in FIG. 1 is prior art doorstop assembly 10. Prior art doorstop assembly 10 teaches a conventional method to attach, whereby threaded post 40 fastens onto a bottom corner of door 202, seen in FIG. 2. Conventional threaded post 40 has the same configuration and shape of a wood screw. Prior art doorstop assembly 10 has distal end 24 and butt end 26. Threaded post 40 is attached or machined to butt end 26. Prior art doorstop assembly 10 is then attached to door 202, by simultaneously pushing and turning prior art doorstop assembly 10 in a clockwise direction into the bottom corner of door 202 until threaded post 40 grabs material of the bottom corner of door 202 and butt end 26 is firmly seated against a surface of the bottom corner of door 202. Distal end 24, and more specifically bumper head 32, is designed to make contact with the baseboard. As also seen in FIG. 1, prior art doorstop assembly 10 comprises door stop 20 having shaft 22 that extends between distal end 24 and butt end 26. Protruding from distal end 24 is bumper assembly 30 comprising bumper head 32. Protruding from butt end 26 is threaded post 40. Threaded post 40 comprises shaft 44 that extends between end 42 and end 48. Shaft 44 comprises threads 46.

The problem with attaching/fastening prior art doorstop assembly 10 to the bottom corner of door 202, is the inevitability that of connection weakening and loosing its foothold. In regards to its strength, prior art doorstop assembly 10 has minimal resistance to both lateral and vertical forces. If any of such forces is applied either purposefully or accidently, prior art doorstop assembly 10 is detached leaving its connection to the bottom corner of door 202 destroyed. A user must then attempt to reattach prior art doorstop assembly 10 to another portion of door 202, as close as possible to the previous hole, potentially leaving an unsightly mark and spoiling the finish of door 202.

Present invention 100 is an improvement to prior art doorstop assembly 10 traditionally used to prevent a doorknob from causing damage to an adjacent wall, upon opening a door.

Figure 2:
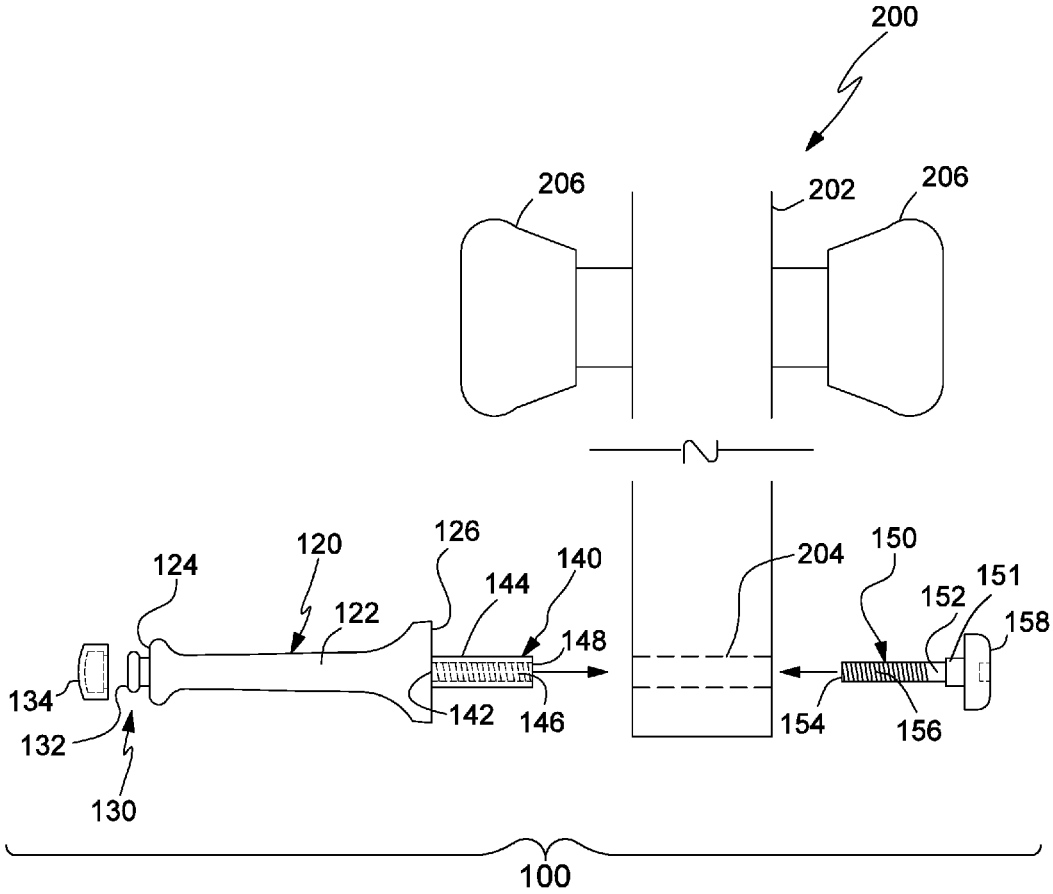
FIG. 2 is a side view of the present invention being mounted onto a door assembly.

As seen in FIG. 2, present invention 100 introduces a modification to the method for attaching/fastening a doorstop to door 202. Present invention 100 decreases the probability of damage to both door 202 and present invention 100.

Present invention 100 comprises distal end 124, butt end 126, post 144, and fastener 150. Post 144 is designed with internal threads 146 as a female configuration, while fastener 150 comprises shaft 152 having threads 156 as a male counter part. Fastener 150 further comprises shoulder section 151, head 158 and end 154. As also seen in FIG. 2, present invention 100 comprises door stop 120 having shaft 122 that extends between distal end 124 and butt end 126. Protruding from distal end 124 is bumper assembly 130 comprising bumper head 132. Cap 134 snugly fits onto bumper head 132. Protruding from butt end 126 is post assembly 140. Post assembly 140 comprises post 144 that extends between end 142 and end 148.

As seen in FIG. 2, door assembly 200 comprises door 202 having hole 204, typically placed at a bottom corner, and doorknobs 206.

For installation, hole 204 is drilled spanning an entire width of door 202. The width of door 202 is slightly larger than post 144. Present invention 100 is then mounted to the door 202 side/surface that, when open, makes contact with a wall by inserting post 144 through door 202 at drilled hole 204, while fastener 150 is inserted through an opposite side of door 202 at drilled hole 204. This configuration permits to join the two parts, internal threads 146 as the female configuration of post assembly 140, and fastener 150, from opposite sides of door 202; not only strengthening the attachment but also its support to door 202 to increase its mounting efficiency. This arrangement increases the strength and resistance of present invention 100 to forces in all planes. Thus, eliminating the possibility of damage to both door 202 and present invention 100, while fulfilling its common use to prevent damage to the adjacent wall.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A barrel bolt doorstop assembly in combination with a door, consisting essentially of:

A) a doorstop comprising a first shaft extending between a distal end and a butt end, protruding from said butt end is a post assembly comprising a post extending between first and second ends, said post assembly further comprising internal threads;

B) a fastener comprising a second shaft having threads, a head and a third end, said fastener further comprises a shoulder section protruding from said head that extends to said second shaft, whereby said shoulder section is larger in diameter than said second shaft, said threads extend from said third end towards said head;

C) a bumper assembly comprising a bumper head, said bumper head has a convex removable cap that fits thereon; and D) a door comprising first and second sides, at least one doorknob, and a hole, said hole extends between said first and second sides, said first end of said post assembly is mounted into said hole from said first side of said door, whereby a width of said door is larger than a length of said post, and said third end of said fastener is mounted into said hole from said second side of said door, whereby said shoulder section fits in said hole, and said first end receives said third end and said fastener tightens into said post assembly.

* * * * *